United States Patent [19]

Stanley

[11] 4,063,585

[45] Dec. 20, 1977

[54] DISPLAY ASSEMBLY AND COMPONENT PARTS THEREFORE

[76] Inventor: Timothy Prescott Stanley, 70 Glen Forest Road, Bramalea, Ontario, Canada, L6S 1M2

[21] Appl. No.: 768,599

[22] Filed: Feb. 14, 1977

[51] Int. Cl.[2] ..... A47G 5/00

[52] U.S. Cl. ..... 160/135; 160/229 R

[58] Field of Search ..... 160/135, 229 R, 351; 16/128; 52/70, 71; 211/198, 199, 200; 403/396, 397, 390, 121; 24/81 CC

[56] References Cited

U.S. PATENT DOCUMENTS

| | | | |
|---|---|---|---|
| 190,171 | 5/1877 | Walker | 211/199 |
| 257,765 | 5/1882 | Rowe | 211/199 |
| 3,353,774 | 11/1967 | Thomas | 403/396 |

*Primary Examiner*—Peter M. Caun
*Attorney, Agent, or Firm*—Hirons & Rogers

[57] ABSTRACT

Movable partitioning, e.g. for display booths at exhibitions and the like, comprises partition members having generally rectangular frames, the side members of which are fitted with cylindrical collars. The cylindrical collars form the broadest part of the exterior surface of the side frame members. The partition members are assembled by placing them, at any desired relative angle, with their cylindrical collars touching, and binding them around their cylindrical collars with releasable binding straps. Two, three, four or more panels can be secured into a single joint in this manner. The display is simply and quickly dismantled into individual partition members by removing the binding straps. The display provides great versatility as regards the formations in which it can be assembled.

5 Claims, 13 Drawing Figures

DISPLAY ASSEMBLY AND COMPONENT PARTS THEREFORE

FIELD OF THE INVENTION

This invention relates to movable partitions of the type commonly used for display boards or panels at temporary exhibitions, rearrangeable subdivision of open plan interiors such as offices, and similar uses. It also relates to component parts for use in such movable partitions, and means for rapid assembling and dismantling of such movable partition systems.

BACKGROUND OF THE INVENTION AND PRIOR ART

An exhibitor at an exhibition or trade fair commonly rents exhibition space for a short period of time, and erects in his rental space, flat display structures such as display panels, boards and the like, bearing charts, pictures, diagrams or models. The display boards are often in the form of self-supporting structures. Such displays have been carefully constructed and designed by the exhibitor prior to the opening of the exhibition, so as to give the most aesthetically pleasing and informative display which the exhibitor is capable of presenting. However, the display structure must normally be transported to the exhibition site in pieces and then erected on the spot. It often proves difficult in practice to produce a satisfactory display in unfamiliar surroundings. Particularly where the display comprises a series of partition members which must be hingedly connected together and arranged angularly with respect to one another so as to be self-supporting and give the desired visual effect, problems may arise when it is assembled in unfamiliar surroundings. For example, with conventional hinged-together display panels or screens, only one side of the hinge joint is presentable, the back of the hinge normally being unsightly, and needing to be concealed. Also, hinges have limited angles of movement. Since there is no simple way of making vertical adjustment of normal hinge connections, the existence of an uneven floor in a display area can present real problems to the assembly of such a display in an aesthetically pleasing manner. It is also time consuming to assemble and dismantle such displays. Once such displays, with conventional hinged joints and wooden frames, have been assembled and dismantled two or three times, the appearance of the joints starts to deteriorate.

BRIEF SUMMARY OF THE INVENTION

It is an object of the present invention to provide a novel movable partitioning and display system which is simple to assemble and dismantle.

It is a further object of the present invention to provide such a system which is versatile in the number of diverse arrangements in which it can be assembled, and is at the same time of pleasing appearance.

It is a further object to provide such a system having joints which allow simple adjustment of the relative position of the component partition members, and which joints are of substantially the same appearance from all sides.

Other objects and advantages will become apparent from the following description.

Briefly stated, the present invention provides movable partitioning and display system comprising a plurality of relatively movable partition members assemblable with and dismantable from one another. Each partition member comprises at least one side frame member having at least one first length portion of circular transverse cross section presenting a cylindrical outer surface, and residual second length portions of smaller cross section. The outer surfaces of the second length portions are disposed wholly within the axial lengthwise projection of the cylindrical outer surface of the first length portion, so that the first length portion surfaces can be used as "bearing", pivot surfaces for adjacent partition members. The partition members are positionable with respect to one another with respective first length portions on side frame members thereof juxtaposed and with cylindrical outer surfaces thereof touching one another on assembly to form a system. Releasable binding means are provided, adapted to surround and tightly bind together groups of two or more juxtaposed first length portions of respective partition members, on assembly thereof to form said system.

The system according to the present invention thus eliminates conventional hinges which have to be fixedly secured to the frame members, in favour of releasable connections or joints comprised of co-operating cylindrical surface formations, releasably bound together. A number of substantial and significant advantages in practice flow from this arrangement. One of these is the ease with which such a system can be erected and dismantled. Another is the versatility of the system. The partition members can be arranged at any angle relative to one another. Three or more partition members can be arranged, to radiate from a single joint. The arrangement can be changed at a moment's notice, by simple steps. The joints present the same, generally pleasing visual appearance from all sides, so that there is no unsightly angle of the joint which should be concealed. Further, the relative heights of the partition members can be adjusted at the joints, to accommodate uneven floors.

DESCRIPTION OF THE PREFERRED EMBODIMENTS

Preferably, each side frame member of a partition member according to the invention has at least two of the aforementioned first length portions, each presenting a cylindrical outer surface, these two portions being spaced apart from each other along the length of the side frame member. Preferably also, the side frame members comprise struts of generally constant cross sectional shape and size along the length thereof, the first length portions thereof comprising rigid cylindrical collars tightly fitted over the exterior of the struts at spaced apart locations along the length thereof, and the residual second length portions being comprised of the residual length sections of the struts uncovered by the collars. Additionally, the collars may be positionally adjustable along the length of the side frame members. In the alternative, the side frame members may comprise struts having integral first and second length portions, the first length portions being cylindrical and of larger cross section than the residual, second length portions, the struts being made as unitary, one-piece castings. As a further alternative, the larger, cylindrical length portions may be welded or otherwise permanently affixed to the residual length portion, to form integral, one-piece struts.

In a preferred embodiment, the binding means comprises flat flexible straps, with tightening means such as buckles thereon, the cylindrical collars having circumferential grooves therein to receive and retain the straps on tightening. Suitably, the strapping is of metal, plastic, fibre, plasticfibre combination or the lie. Such strappings are well known in the art, as bindings for other purposes, such as the securing of cardboard containers.

In the case where the frame member strut is of a cross section other than circular, separate cylindrical collar members are preferably made and applied to the strut. However, when the strut itself is of circular cross section, the first length portion presenting the largest cylindrical outer surface may be an integral portion of the strut itself. It will be appreciated that the frame members may be made of any of a wide range of materials, including wood (commonly), metals and plastic.

BRIEF REFERENCE TO THE DRAWINGS

Figure 1:
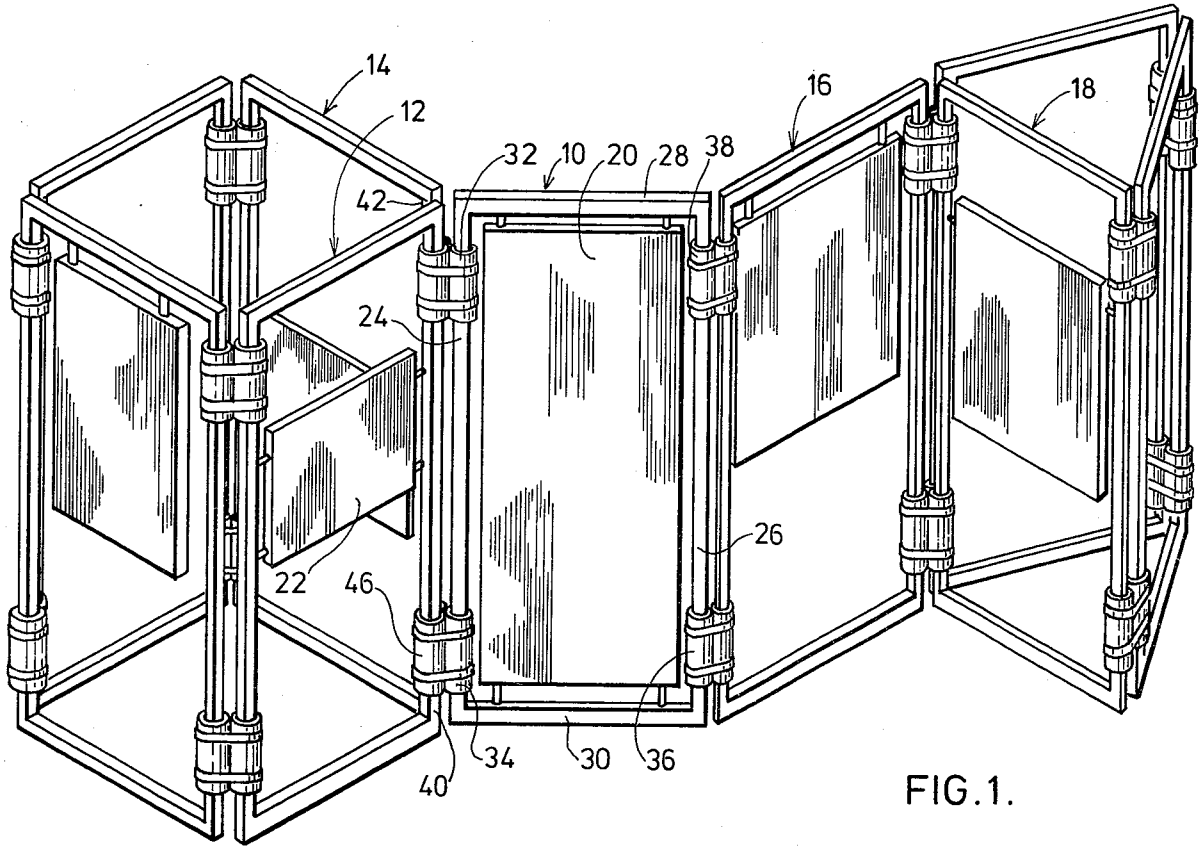
FIG. 1 is a perspective view of an assembled display system according to the present invention.

FIGS. 4*a* – 4*e* are transverse cross sectional views of various forms of side frame member struts enclosed in collars, for use in joints in display systems according to the invention;

FIGS. 5 – 9 are diagrammatic transverse cross sections of various arrangements of joints according to the invention.

In the drawings, like reference numerals indicate like parts.

DETAILED DESCRIPTION OF THE SPECIFIC EMBODIMENT

With reference to FIG. 1, a display system according to the invention comprises a plurality of partition members 10, 12, 14, 16, 18, etc. comprising rectangular frames and panels 20, 22 etc. mounted therein, of various shapes and sizes, and bearing material for exhibition or display. In the embodiment shown, the partition members, exemplified by member 10, are supported in an upright condition on a base surface, such as an exhibition hall floor. Each partition member such as 10, has side frame members 24, 26 in the form of wooden struts of generally square cross section, and similar top and bottom frame members 28, 30, respectively.

The side frame member 24 has a generally cylindrical collar 32 fitted tightly thereover, near the top of side frame member 24, and a similar cylindrical collar 34 fitted tightly thereover, near the bottom of side frame member 24. Similar cylindrical collars 36, 38 are provided on the other side frame member 26 of partition member 10, at about the same spacings from the top and bottom thereof as corresponding cylindrical collars 32, 34. As shown in FIG. 1, all of the other partition members 12, 14, 16, 18 etc. are similarly provided with cylindrical collars on their side frame members, at approximately the same distances from top and bottom thereof. Thus, in the erected, assembled system resting on a generally flat surface, the cylindrical collars on the respective partition members register and can be put into juxtaposition with one another.

Figure 2:
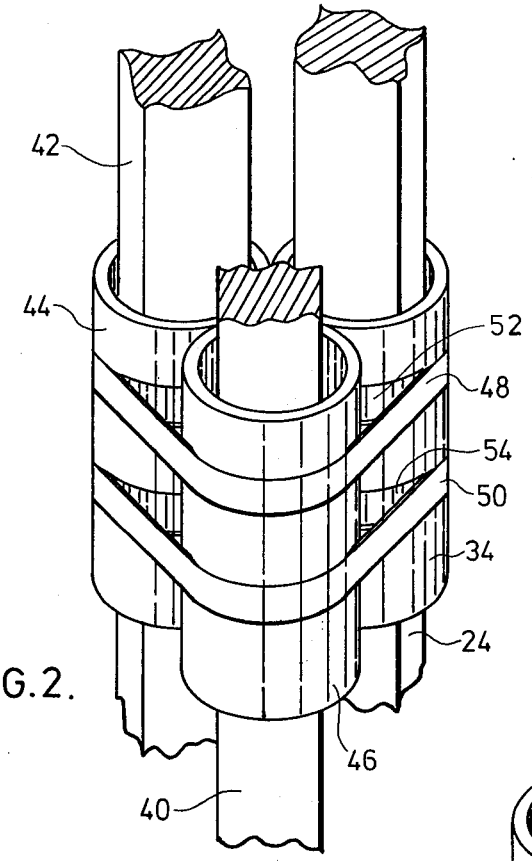
FIG. 2 is a detail of one of the joints between display panels in the system of FIG. 1.
Figure 3:
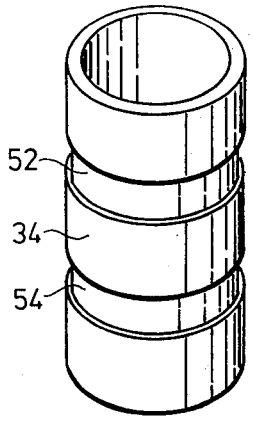
FIG. 3 is a perspective view of a collar for use in the joint of FIG. 2.
Figure 4A:
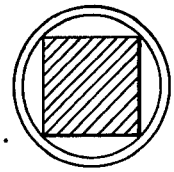
Figure 4B:
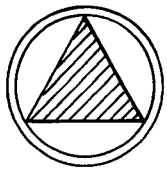
Figure 4C:
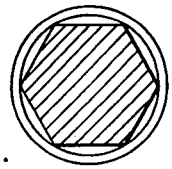
Figure 4D:
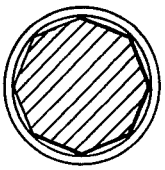
Figure 4E:
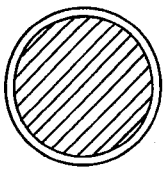

Thus, partition members 10, 12, and 14 are erected in the system illustrated in FIG. 1, with their respective side frame members 24, 40, 42 adjacent and parallel to one another with respective cylindrical collars touching. The lower of these assemblies or joints of cylindrical collars is shown in more detail in FIG. 2.

Partition member 14 has a side frame strut 42, fitted with a lower cylindrical collar 44, and the partition member 12 has a side frame strut 40 fitted with a similar lower cylindrical collar 46. Binding means in the form of a pair of flexible, flat straps 48, 50, encircle the juxtapositioned, touching collars 34, 44, 46 and hold them tightly together. Each of the collars such as 34 is provided with upper and lower circumferential grooves 52, 54 in which the respective straps 48, 50, are received, to retain them against vertical displacement when tightened. Tightening means in the form of buckles, staples, or the like (not shown) may also be provided to secure the straps to themselves after tightening. Other securing methods may also be adopted such as heat sealing of thermoplastic straps.

Figure 5:
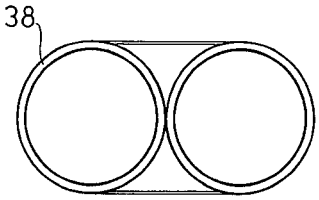
Figure 6:
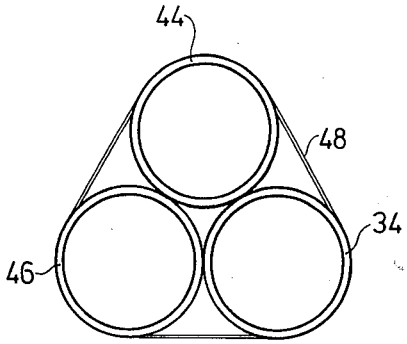
Figure 7:
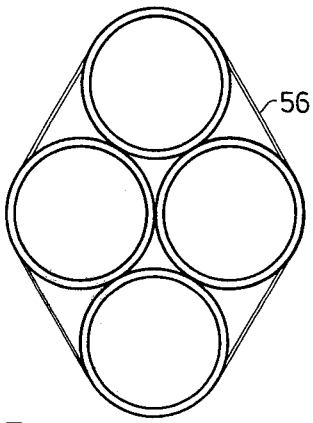
Figure 8:
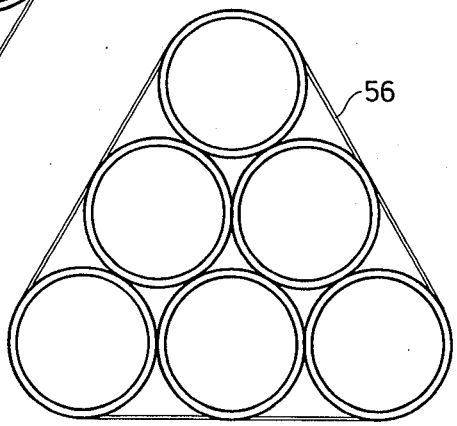
Figure 9:
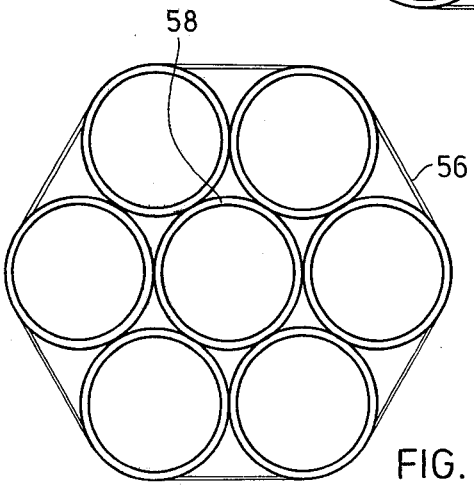

As will be appreciated from FIG. 1, all of the joints between the various partition members are essentially the same, involving the junction of two or three partition members by surface engagement of cylindrical collars thereon, bound together by releasable straps. FIG. 5 illustrates diagrammatically in section a two component joint, such as that between partition members 10 and 16 of FIG. 1. FIG. 6 similarly shows diagrammatically the arrangement of the joint of FIG. 2. More than three partition members can be joined together in this manner if desired. If four partition members are to be joined at one location, the arrangement of the cylindrical collars is suitable as shown in FIG. 7, with the tightened strap 56 surrounding them forming a generally parallelogram shape as viewed in transverse cross section, so that each cylindrical collar touches against two others. A six member joint may have a triangular such arrangement, as shown in FIG. 8, for the same purpose. Alternatively, a six member joint may be as shown in FIG. 9, incorporating a separate strut bearing similar cylindrical collars 58, not associated with any partition member, with the collar 58 of the separate strut at the centre of the joint as viewed in transverse cross section and the six collars on side frames of the partition members arranged radially around it. A partition member of a system according to the invention which is jointed at one end only can, of course, be used as a hinged door.

As shown in FIG. 4, the strut, e.g. 42, comprising the side frame member of the partition member can have a variety of cross sectional shapes such as square (FIG. 4a), triangular (FIG. 4*b*), hexagonal (FIG. 4*c*), octagonal (FIG. 4*d*), circular (FIG. 4*e*) etc., provided that it can be made to fit tightly inside the cylindrical collar 34. The two collars provided on a single side frame strut, e.g. collars 32 and 34, should be of essentially the same external dimensions, for best appearance of the assembled system. Whilst the collars should be a tight fit on the struts, it is preferred that they be forcibly movable up and down the struts, e.g. by striking them, and even removable from the ends of the struts by such means. In a further alternative, the collar, instead of being a force fit on the struts, may be threaded, bolted, clamped or otherwise fixed on the struts. The collars can be made of metal such as steel, aluminum, brass etc. or of hard rigid plastics such as ABS, polyethylene, polypropylene, nylon, polycarbonates etc.

It will be seen that the display system according to the invention is simple, easy and versatile in assembly and dismantling, and presents extremely flexible arrangement possibilities. The various display panels or partition members can be assembled at a whole variety of different angles to one another, by use of joints as described. Any size or shape of display area can be used, in an aesthetically pleasing manner. The display panels or partition members according to the invention can also be assembled as shelves, tables or the like, to make box displays, temporary booths, dressing rooms, movie screens etc. The use of conventional hinge connections between panels wth their consequent ugly looking reverse sides, requirement for assembly in a semi-permanent manner and as a time consuming operation, and probably destructive dismantling, is avoided. Moreover, uneven floors can be allowed for, by relative adjustment of the heights of the cylindrical collars on the respective side frame members. On dismantling, it is merely necessary to remove the binding straps, e.g. by disconnecting or even cutting them, to separate the display system into individual units for ease of transportation. There is no significant risk of damage to the frame members, so that the partition members can be assembled and dismantled over and over again, with the same or different material displayed on them. All the component parts are simple and hence economical to manufacture.

Whilst the system according to the invention has been disclosed for use as a display system, it will be appreciated that it has many other applications. In general, it can be used wherever portable, readily assembled and dismantled partitioning is required, such as office interiors, hospital ward subdivision, temporary fencing and the like. Further, the system according to the invention can be used otherwise than as a floor-supported, standing arrangement. The partition members may be suspended clear of the floor, and arranged vertcially, horizontally or at intermediate angles, and used to support overhead lighting or other displays. The partition members need not be rectangular as illustrated, but triangular or other polygonal shapes with at least one generally straight side frame member with first and second length portions as described, to cooperate with a similar straight side frame member of an adjacent partition member. By use of various polygonal shapes of partition members, geodesic structures may be assembled. A variety of different sizes of partition members may also be used. The scope of the invention is only limited by the appended claims.

What I claim is:

1. Movable partitioning and display system comprising a plurality of relatively movable partition members assemblable with and dismantlable from one another;

each partition member comprising at least one side frame member in the form of a strut having a non-circular cross sectional shape, said strut having at least two first length portions comprising cylindrical collars on the exterior of said strut at spaced apart locations along the length thereof, and residual second length portions of smaller cross section, the outer surfaces of said second length portions being disposed wholly within the axial lengthwise projection of the cylindrical outer surface of said first length portion;

said partition members being positionable with respect to one another with respective first length portions on side frame members thereof juxtaposed and with cylindrical outer surfaces thereof touching one another on assembly to form the system;

and releasable binding means adapted to surround and tightly bind together groups of two or more juxtaposed first length portions of respective partition members on assembly thereof to form said system.

2. The partitioning and display system of claim 1 wherein said side frame members comprise struts of generally constant cross sectional shape and size along the length thereof, the first length portions thereof comprising rigid cylindrical collars tightly fitted over the exterior of, but positionally adjustable along the length of, said struts at spaced apart locations along the length thereof, the residual second length portions comprising the residual length sections of the struts uncovered by said collars.

3. The partitioning and display system of claim 2, wherein said releasable binding means comprise flat, flexible straps and wherein said cylindrical collars have circumferential grooves in the outer surface thereof, to receive said flexible straps on tightening thereof.

4. The partitioning and display system of claim 2, wherein each partition member is of generally rectangular form, and has two said struts forming opposed generally parallel side frame members thereof.

5. A partition member for use as part of a display or partition system according to claim 1, comprising at least one side frame member in the form of a strut of generally constant cross sectional shape and size, and at least two rigid cylindrical collars tightly fitted over the exterior of each of said struts, the collars presenting cylindrical outer surfaces, and the outer surfaces of the struts at positions not overlaid by said collars being located wholly within the axial lengthwise projection of the cylindrical outer surfaces of said collars.

* * * * *